US011565385B2

(12) United States Patent
Lai

(10) Patent No.: US 11,565,385 B2
(45) Date of Patent: Jan. 31, 2023

(54) RATCHET TOOL

(71) Applicant: KING TONY TOOLS CO., LTD., Taichung (TW)

(72) Inventor: Ching-Hua Lai, Taichung (TW)

(73) Assignee: KING TONY TOOLS CO., LTD., Taichung (TW)

( * ) Notice: Subject to any disclaimer, the term of this patent is extended or adjusted under 35 U.S.C. 154(b) by 303 days.

(21) Appl. No.: 16/985,840

(22) Filed: Aug. 5, 2020

(65) Prior Publication Data

US 2021/0362302 A1 Nov. 25, 2021

(30) Foreign Application Priority Data

May 22, 2020 (TW) ..... 109117124

(51) Int. Cl.
*B25B 13/46* (2006.01)
*B25B 13/06* (2006.01)

(52) U.S. Cl.
CPC ..... *B25B 13/465* (2013.01); *B25B 13/06* (2013.01)

(58) Field of Classification Search
CPC ..... B25B 13/465; B25B 13/06
USPC ..... 81/63.2
See application file for complete search history.

(56) References Cited

U.S. PATENT DOCUMENTS 3,222,943 A * 12/1965 McDonald ..... F16D 41/16 74/157
3,393,780 A * 7/1968 Kilness ..... B25B 13/463 81/63
4,807,500 A * 2/1989 Main ..... B25B 13/465 81/60
7,444,904 B2 * 11/2008 Huang ..... B25B 13/463 192/43.2
9,114,511 B1 * 8/2015 Wang ..... B25B 13/465

* cited by examiner

*Primary Examiner* — Hadi Shakeri
(74) *Attorney, Agent, or Firm* — Birch, Stewart, Kolasch & Birch, LLP

(57) ABSTRACT

A ratchet tool comprises a base, a ratchet body, a switching member and a pawl member. The base has a rail and is movable with linear motion along the rail between a first position and a second position, the ratchet body has plural teeth, and the pawl member is engaged with the switching member and comprises plural ratchet teeth, a first abutting portion and a second abutting portion. When the switching member is movable to the first position, the pawl member is pivotally rotated to a third position to make the ratchet teeth mesh with the teeth and the first abutting portion abut against the base, therefore the ratchet body enables to rotate along a first rotation direction. When the switching member is movable to the second position, the pawl member is pivotally rotated to a fourth position to make the ratchet teeth mesh with the teeth and the second abutting portion abut against the base, therefore the ratchet body enables to rotate along a second rotation direction.

9 Claims, 18 Drawing Sheets

RATCHET TOOL

BACKGROUND OF THE INVENTION

1. Technical Field

The present invention relates generally to a ratchet tool, and more particularly to a reversible ratchet tool.

2. Description of Related Art

It is known that wrench tools are mainly used to lock or loosen fasteners such as bolts and nuts. In addition to being commonly used in industrial environments, it is also one of the essential hand tools in the toolbox of the general public. Especially, the wrench tool could be used with replaceable adapters having different specifications according to different applications, which is more convenient and flexible in use.

Commonly, adapters of ratchet tools can be replaced for different applications. However, the existing ratchet adapters generally have the disadvantages of inaccurate direction change and inconvenient operation, which needs to be improved.

BRIEF SUMMARY OF THE INVENTION

In view of the above, the primary objective of the present invention is to provide a ratchet tool that is reversible accurately, and the other objective of the present invention is to provide a ratchet tool which is convenient in operation and easy for one-handed operation.

The present invention provides a ratchet tool including a base having a rail, a ratchet body having an inner circular surface which has a plurality of teeth formed thereon, a switching member, and a pawl member. The switching member is located in the rail, wherein the switching member is linearly movable between a first position and a second position along the rail; the switching member comprises a first connecting portion. The pawl member has a plurality of ratchet teeth, a first abutting portion, a second abutting portion, and a second connecting portion, wherein the second connecting portion and the first connecting portion are connected to each other. When the switching member moves to the first position, the switching member drives the pawl member to pivotally rotate to a third position, so that the ratchet teeth mesh with the teeth, and the first abutting portion abuts against the base so that the ratchet body is able to rotate only in a first rotation direction. When the switching member moves to the second position, the switching member drives the pawl member to pivotally rotate to a fourth position, so that the ratchet teeth mesh with the teeth, and the second abutting portion abuts against the base so that the ratchet body is able to rotate only in a second rotation direction; the first rotation direction and the second rotation direction are opposite directions.

With the abovementioned design, the switching member can move linearly between the first position and the second position, which drives the pawl member to mesh with the teeth through a pivotally rotated way, so as to achieve the function of direction switching rapidly. Moreover, a user can switch the direction of the ratchet tool by pressing or pushing the switching member with one hand, which effectively improves the convenience of operation.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
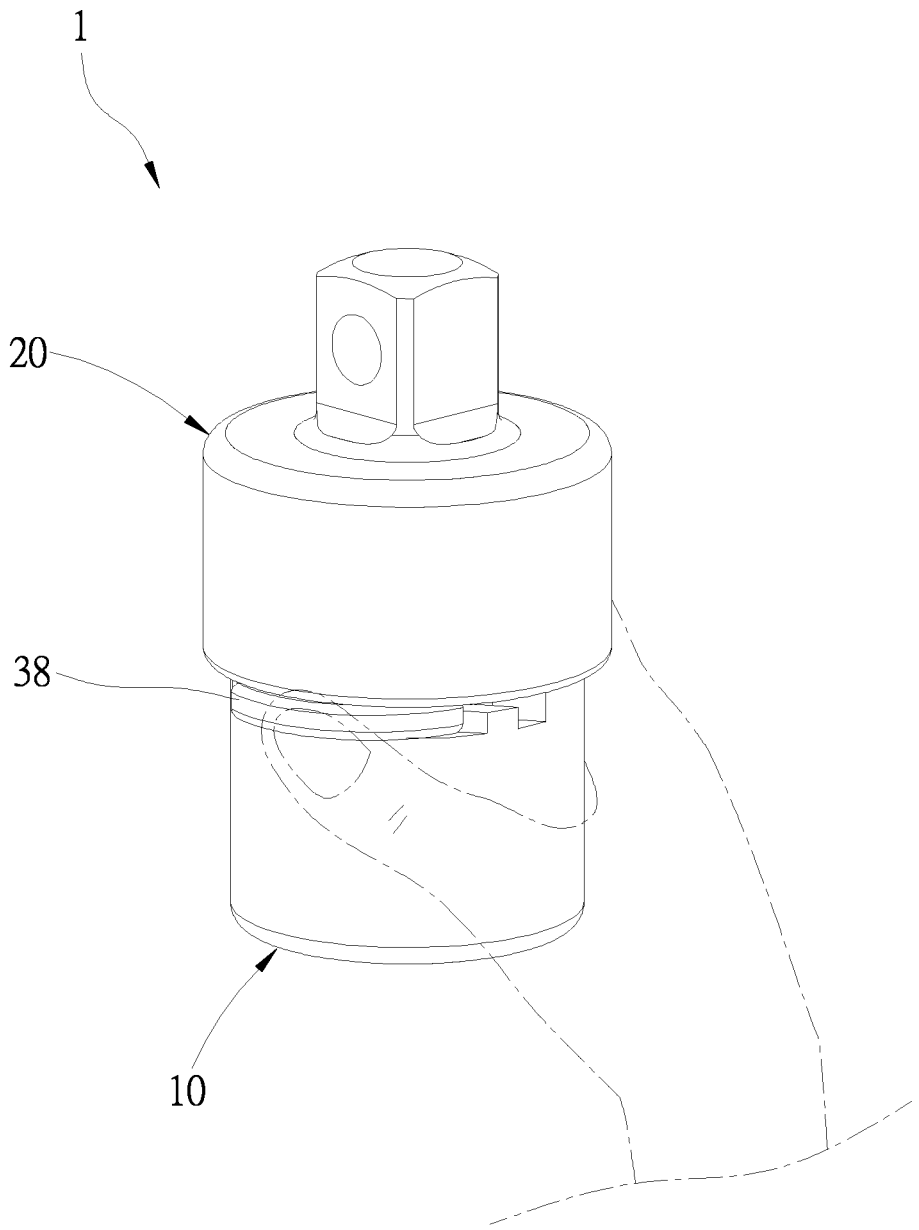
FIG. 1 is a perspective view of the ratchet tool of the first embodiment of the present invention.

As shown in FIG. 1, the first embodiment of the present invention, a ratchet tool 1, is a ratchet adapter.

Figure 2:
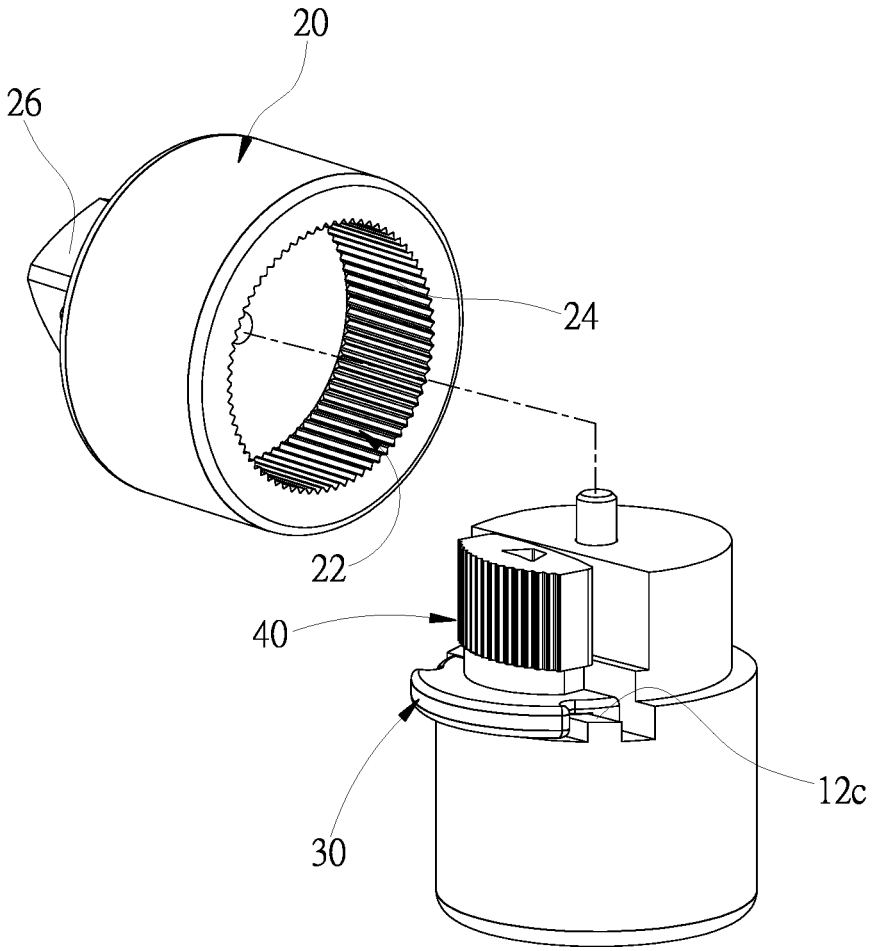
FIG. 2 is an exploded view of the ratchet tool in FIG. 1.
Figure 3:
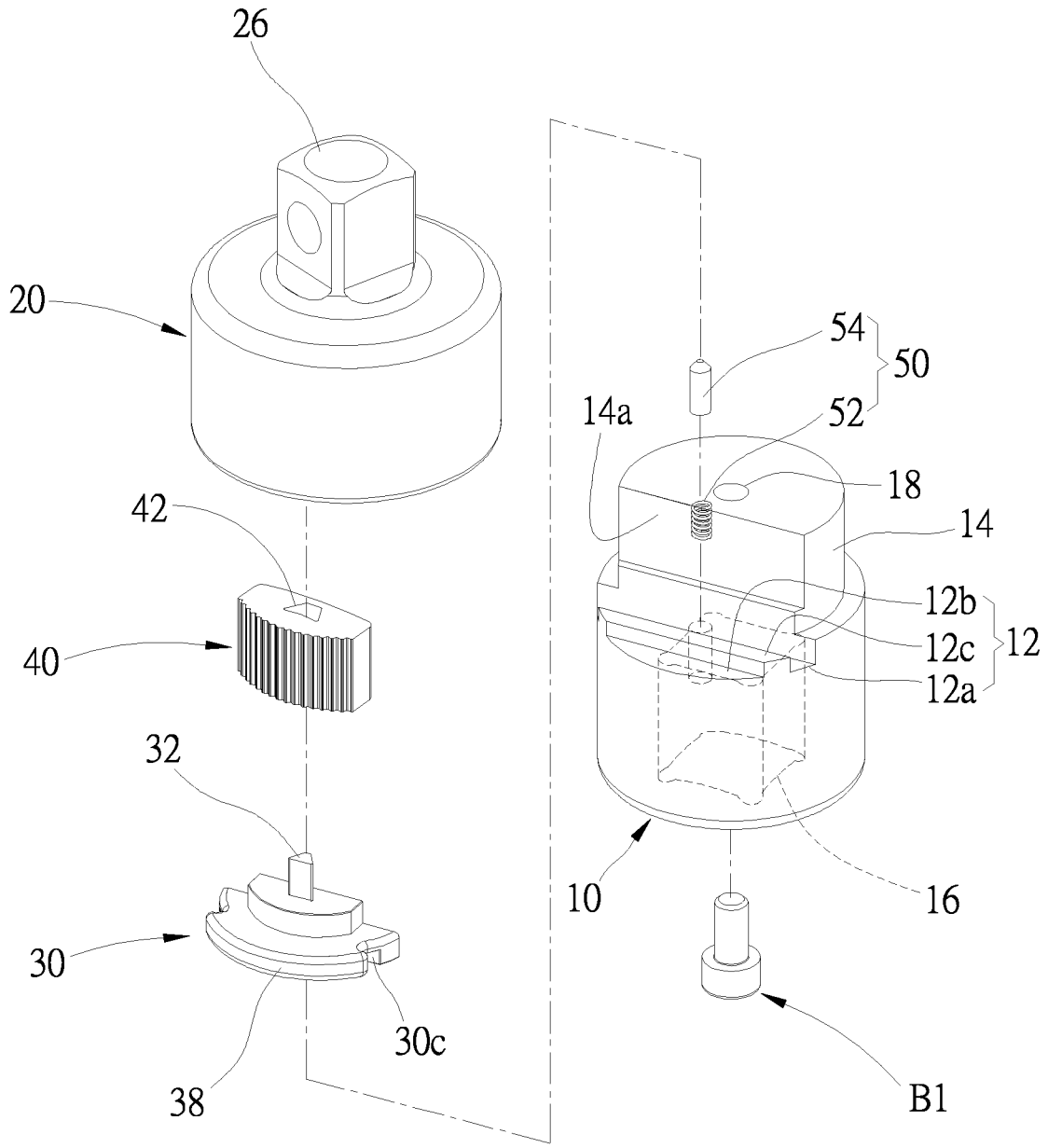
FIG. 3 is an exploded view of the ratchet tool in FIG. 1.

As shown in FIG. 1 to FIG. 3, the ratchet tool 1 includes a base 10, a ratchet body 20, a switching member 30, and a pawl member 40. The base 10 has a rail 12 for installing the switching member 30. In this embodiment, the rail 12 includes a cutting groove 12*a*, a holding space 12*b*, and a rib 12*c* provided between the cutting groove 12*a* and the holding space 12*b*, wherein the cutting groove 12*a* and the holding space 12*b* can be separated by the rib 12*c* to form two individual spaces. The cutting groove 12*a* is a longitudinal groove, and two opposite groove walls thereof are parallel to each other; in addition, the cutting groove 12*a* forms two openings at two sides of the base 10 respectively. One side of the holding space 12*b* away from the cutting groove 12*a* is an open side. A convex column 14 is formed and extended from an end of the base 10, and the other end of the base 10 has a combining groove 16. The combining groove 16 of the ratchet tool 1 in this embodiment is used for combining a wrench tool.

The ratchet body 20 has an accommodating space 22 which has an inner circular surface, wherein a plurality of teeth 24 are formed on the inner circular surface. An end of the ratchet body 20 is formed with a connecting section 26 for connecting a driven member, such as a socket. In this embodiment, the convex column 14 of the base 10 is inserted inside the accommodating space 22, and then a fastener such as a bolt B1 passes through a perforation 18 of the base 10 and be fastened into the ratchet body 20, so that the ratchet body 20 is fixed to the base 10.

Figure 4:
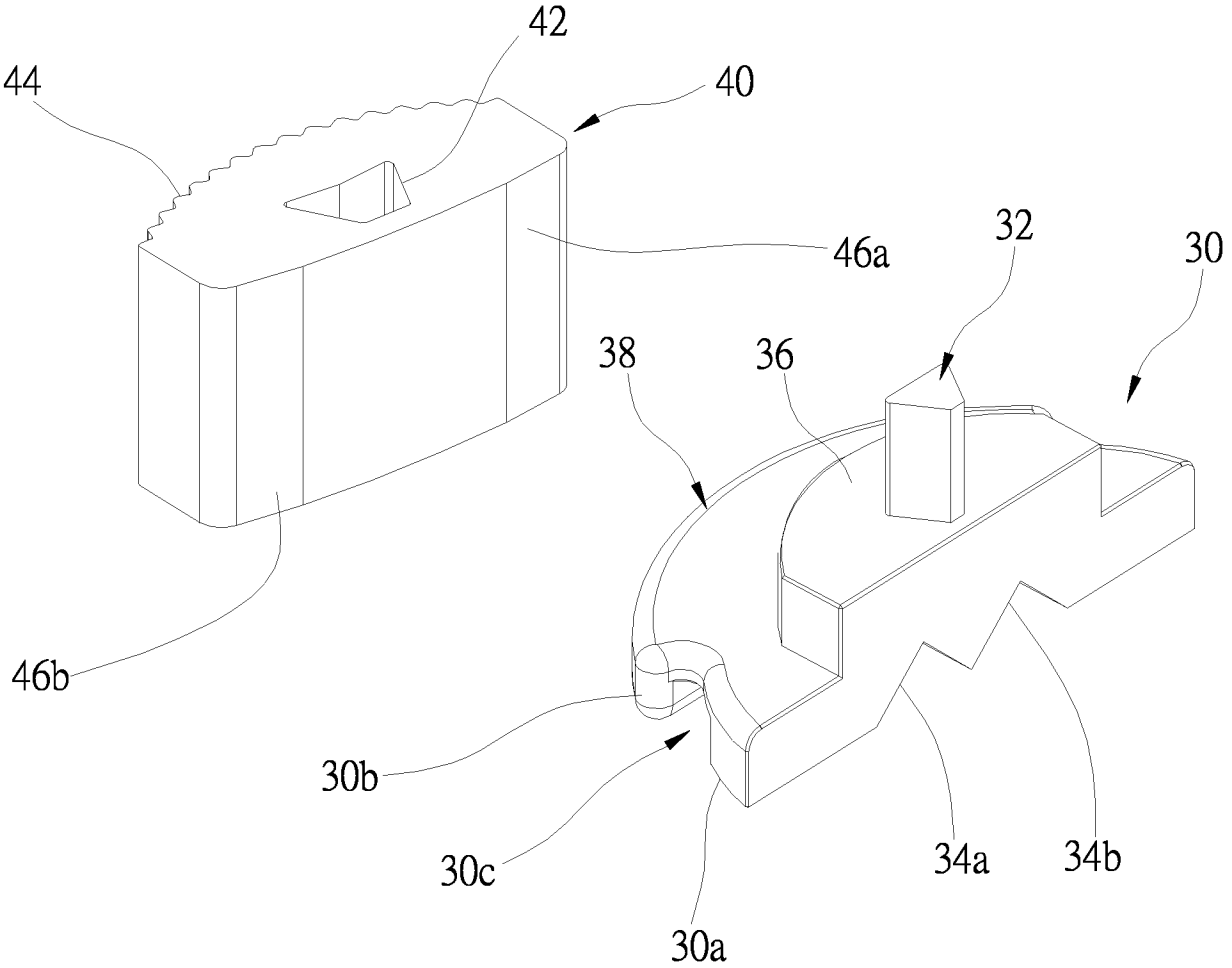
FIG. 4 is a perspective view of the switching member and the pawl member of the first embodiment.
Figure 5:
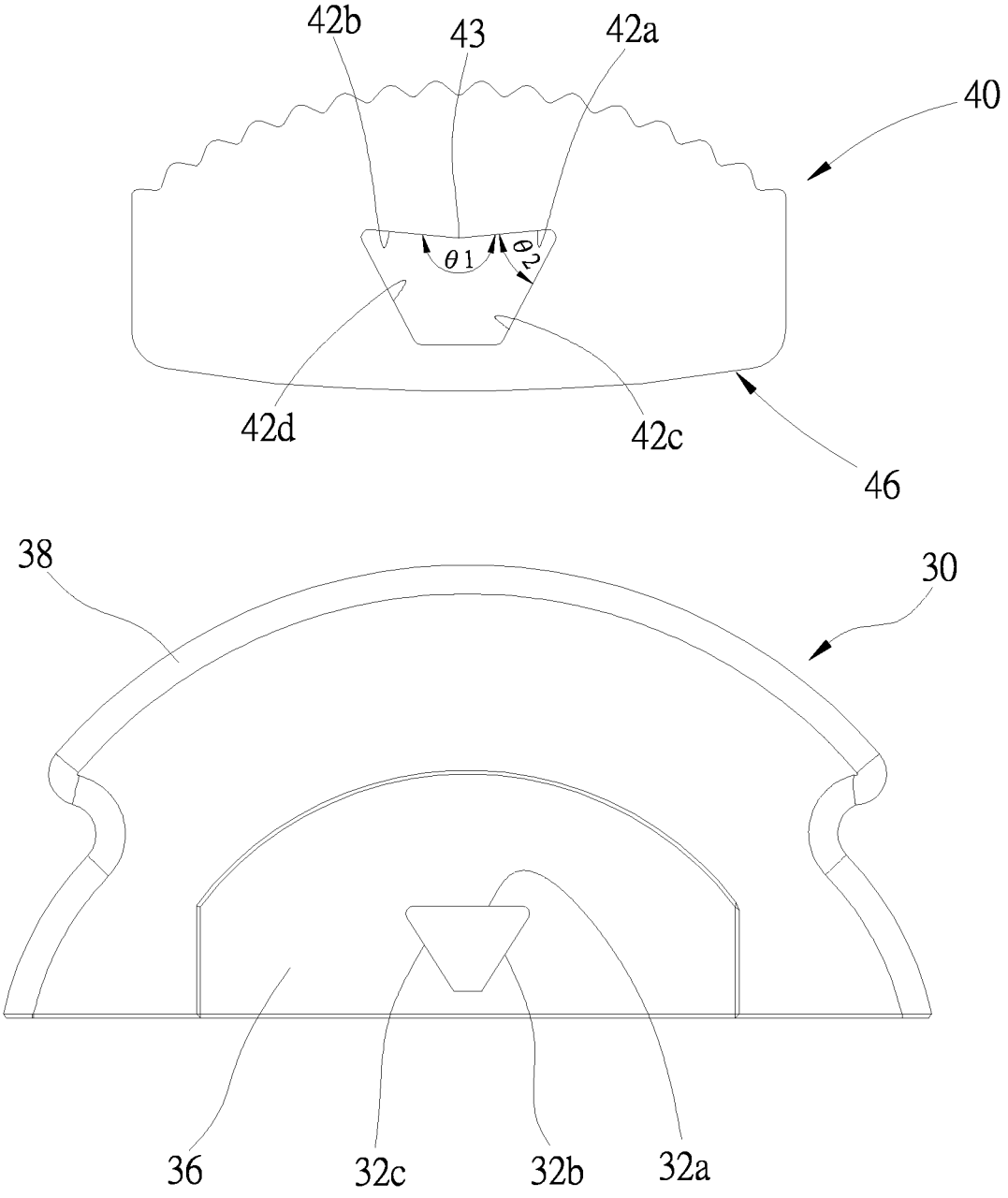
FIG. 5 is a top view of the switching member and the pawl member of the first embodiment.
Figure 6:
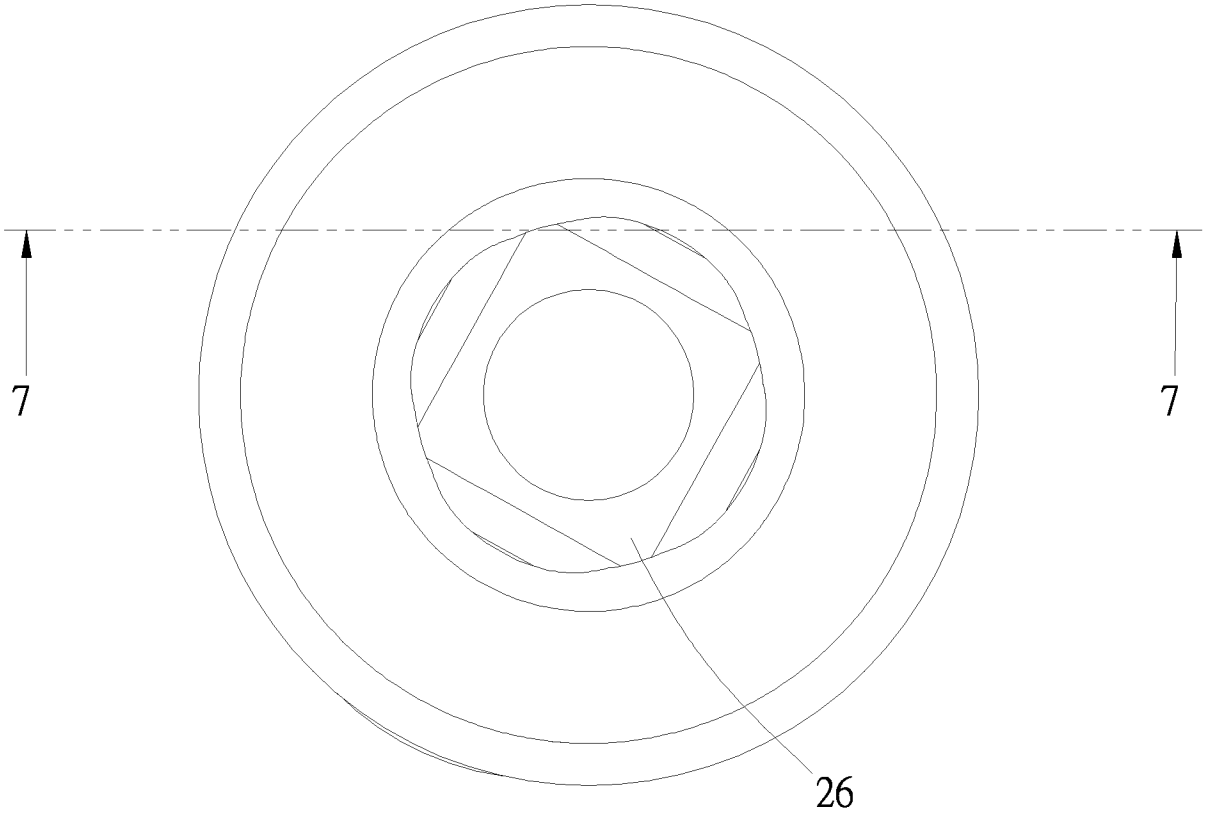
FIG. 6 is a top view of the ratchet tool in FIG. 1.

As shown in FIG. 3 to FIG. 5, the switching member 30 is provided in the rail 12, and is movable between a first position and a second position along the rail 12. The switching member 30 has a first connecting portion 32, a first convex rib 30*a*, a second convex rib 30*b*, and a sliding groove 30*c* located between the first convex rib 30*a* and the second convex rib 30*b*. The first convex rib 30*a* is accommodated in the cutting groove 12*a*, while the second convex rib 30*b* is accommodated in the holding space 12*b*, and the sliding groove 30*c* is disposed on the rib 12*c*. Therefore, the first convex rib 30*a* of the switching member 30 is movable linearly along the cutting groove 12*a* of the rail 12, so that the switching member 30 enables to move linearly between the first position and the second position. The first convex rib 30*a* of the switching member 30 has a first accommodating groove 34*a* and a second accommodating groove 34*b* formed on a bottom of the first convex rib 30*a* for abutment against a positioning device 50. The positioning device 50 is provided to position the location of the switching member 30 on the rail 12. The switching member 30 includes a holding platform 36 disposed on top of the first convex rib 30*a*, wherein the first connecting portion 32 is formed on an upper surface of the holding platform 36, and the pawl member 40 is supported by the upper surface of the holding platform 36. Moreover, one side of the holding platform 36 extends to form a force application protrusion 38, an extension direction of the force application protrusion 38 is different from a moving direction of the switching member 30. Preferably, the extension direction of the force application protrusion 38 is perpendicular to the moving direction of the switching member 30. As shown in FIG. 1, at least a part of the force application protrusion 38 protrudes beyond the base 10. Therefore, a user can flip or push the force application protrusion 38 through hands such as fingers so as to drive the switching member 30 to move between the first position (i.e., the position of the switching member in FIG. 7) and the second position (i.e., the position of the switching member in FIG. 11).

Figure 7:
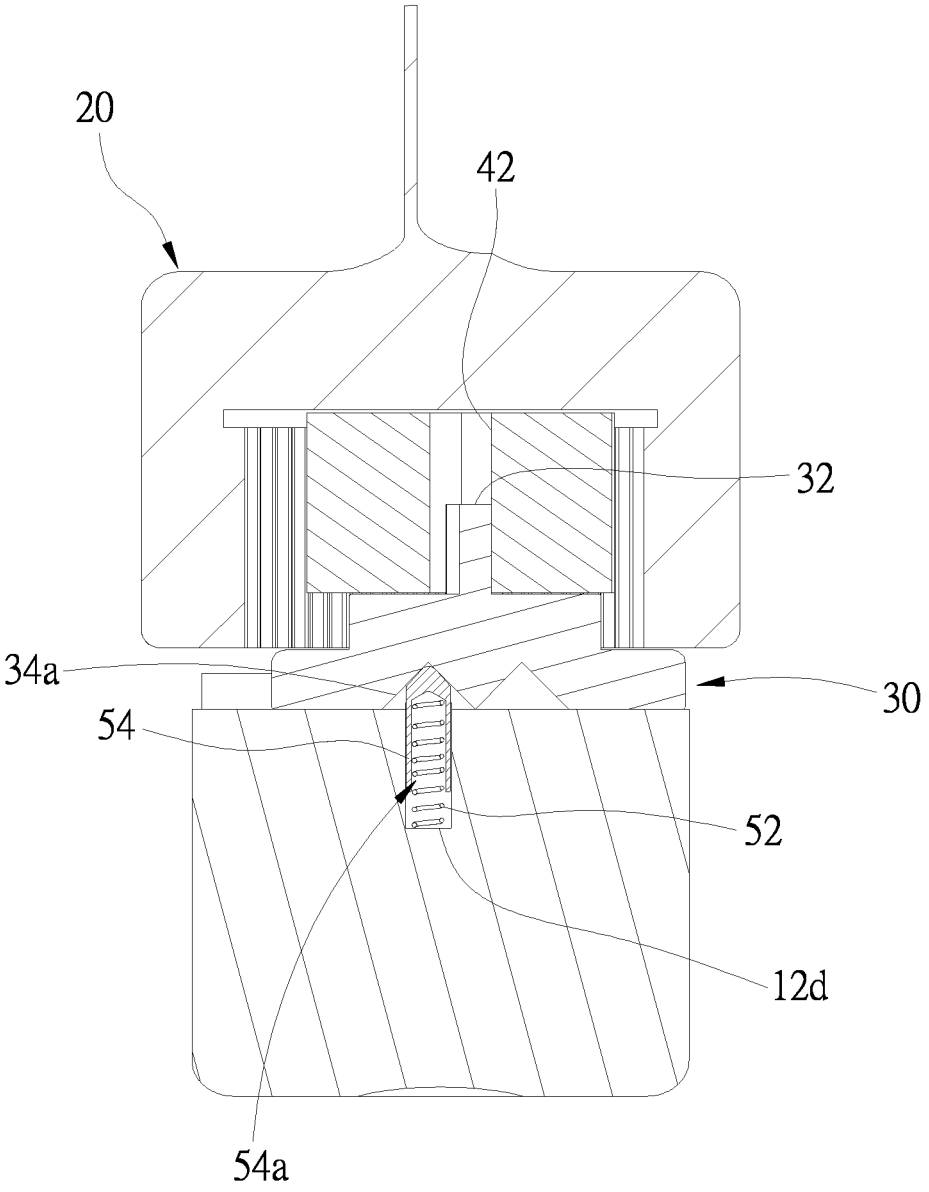
FIG. 7 is a sectional view along the 7-7 line in FIG. 6, showing the switching member is in the first position and the pawl member is in the third position.
Figure 8:
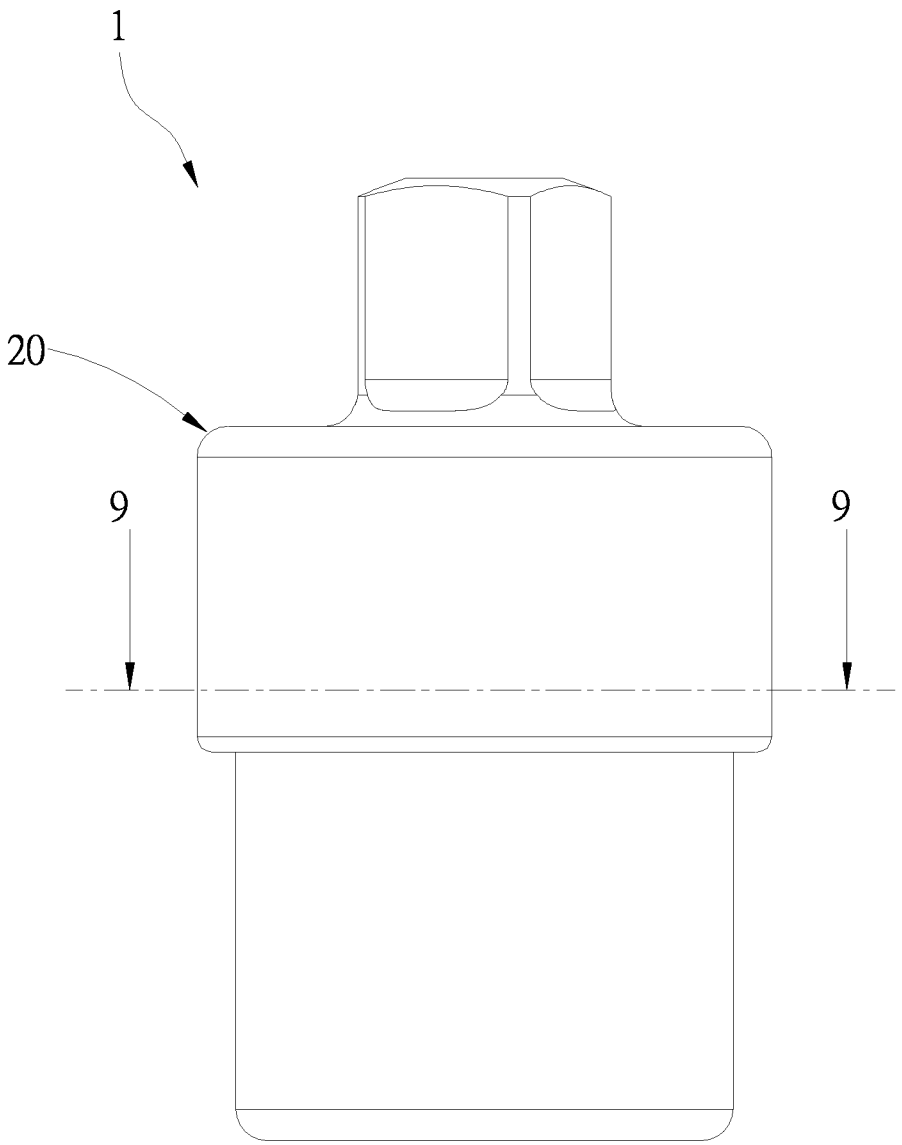
FIG. 8 is a lateral view of the ratchet tool in FIG. 1.

As shown in FIG. 3 and FIG. 7, in this embodiment, the positioning device 50 includes an elastic member 52 and a hollow pin 54. The elastic member 52 is located in a recess 12*d* which is recessed at a bottom of the rail 12. Furthermore, in this embodiment, the recess 12*d* is recessed at a bottom of the cutting groove 12*a*. An end of the elastic member 52 abuts against a bottom of the recess 12*d*, while the other end of the elastic member 52 is inserted inside a cavity 54*a* of the hollow pin 54 and then abuts against the hollow pin 54 elastically so as to provide the hollow pin 54 with an upward elastic force (take the direction of FIG. 7 as an example). The hollow pin 54 is provided between the switching member 30 and the elastic member 52, and is able to constantly abut against the first accommodating groove 34*a* or the second accommodating groove 34*b* by the elastic force from the elastic member 52. The hollow pin 54 can be controlled by the user to selectively abut against the first accommodating groove 34*a* or the second accommodating groove 34*b*.

As shown in FIG. 3 to FIG. 5, the pawl member 40 has a second connecting portion 42 which is connected to the first connecting portion 32 of the switching member 30. Additionally, the pawl member 40 is driven by the switching member 30 to move between a third position (i.e., the position of the switching member in FIG. 7 and FIG. 9) and a fourth position (i.e., the position of the switching member in FIG. 11 and FIG. 12). One side of the pawl member 40 has a plurality of ratchet teeth 44, wherein the ratchet teeth 44 mesh with the teeth 24 of the ratchet body 20; another side of the pawl member 40 abuts against the convex column 14 of the base 10. In this embodiment, the plurality of ratchet teeth 44 are formed on a convex curved surface at one side of the pawl member 40, and the other side of the pawl member 40 has a first abutting portion 46*a* and a second abutting portion 46*b* used for abutment against a surface 14*a* of the convex column 14.

In an embodiment, one of the first connecting portion 32 and the second connecting portion 42 can be a convex column, while the other can be a perforation or a recess which engages with the convex column. In this embodiment, the first connecting portion 32 is a polygonal column which has a first abutting surface 32*a*, a second abutting surface 32*b*, and a third abutting surface 32*c*. The second connecting portion 42 is a polygonal hole provided for the first connecting portion 32 (as shown in FIG. 7), and has a first contact surface 42*a*, a second contact surface 42*b*, a third contact surface 42*c*, and a fourth contact surface 42*d*. Preferably, an angle ⊖1 between the first contact surface 42*a* and the second contact surface 42*b* is greater than 180 degrees. For example, the angle ⊖1 is ranged between 180 and 240 degrees, and is preferably ranged between 190 and 210 degrees. An angle ⊖2 between the first contact surface 42*a* and the third contact surface 42*c* is an acute angle, and an angle (symmetrical as the angle ⊖2) between the second contact surface 42*b* and the fourth contact surface 42*d* is an acute angle. For example, the angle ⊖2 is ranged between 30 and 80 degrees, and is preferably ranged between 45 and 70 degrees. The sum of the angle between the first abutting surface 32*a* and the second abutting surface 32*b* and the angle ⊖2 is approximately less than 360 degrees. The sum of the angle between the first abutting surface 32*a* and the third abutting surface 32*c* and the angle ⊖2 is approximately less than 360 degrees. Moreover, a width of the third contact surface 42*c* is greater than a width of the second abutting surface 32*b*, and a width of the fourth contact surface 42*d* is greater than a width of the third abutting surface 32*c*.

In another embodiment, the first connecting portion 32 can be a perforation, a recess, or a polygonal hole. The second connecting portion 42 can be a convex column or a polygonal column, which can match with the first connecting portion 32.

Figure 9:
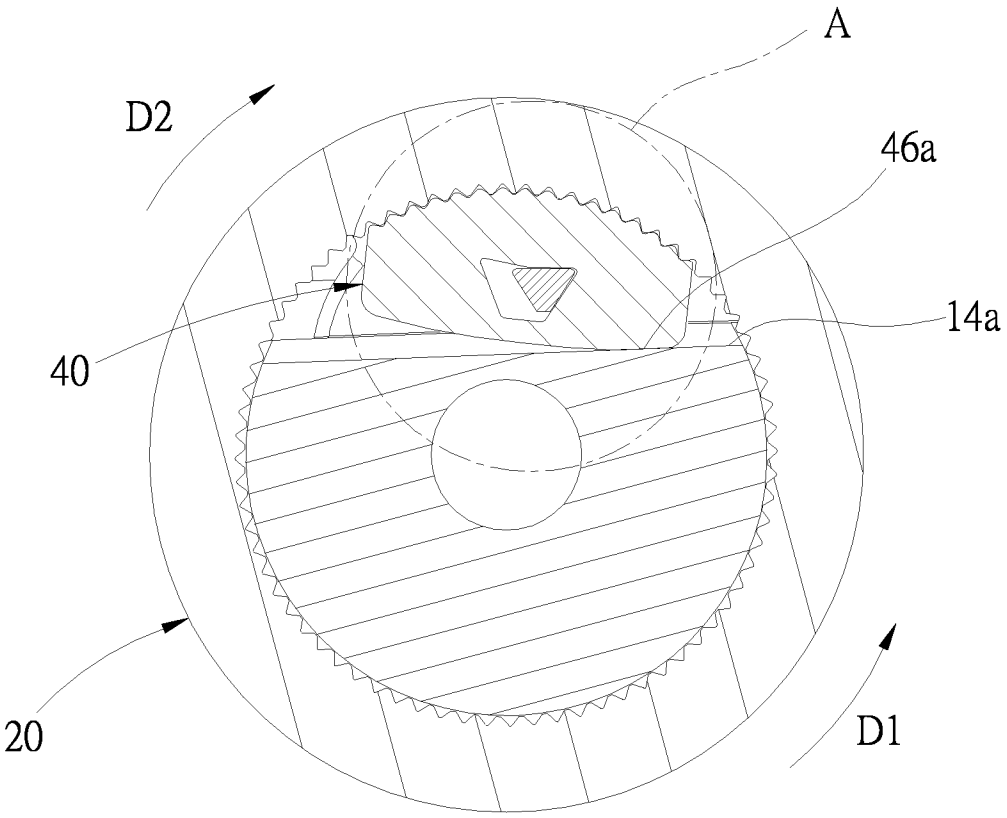
FIG. 9 is a sectional view along the 9-9 line in FIG. 8, showing the switching member is in the first position and the pawl member is in the third position.
Figure 10:
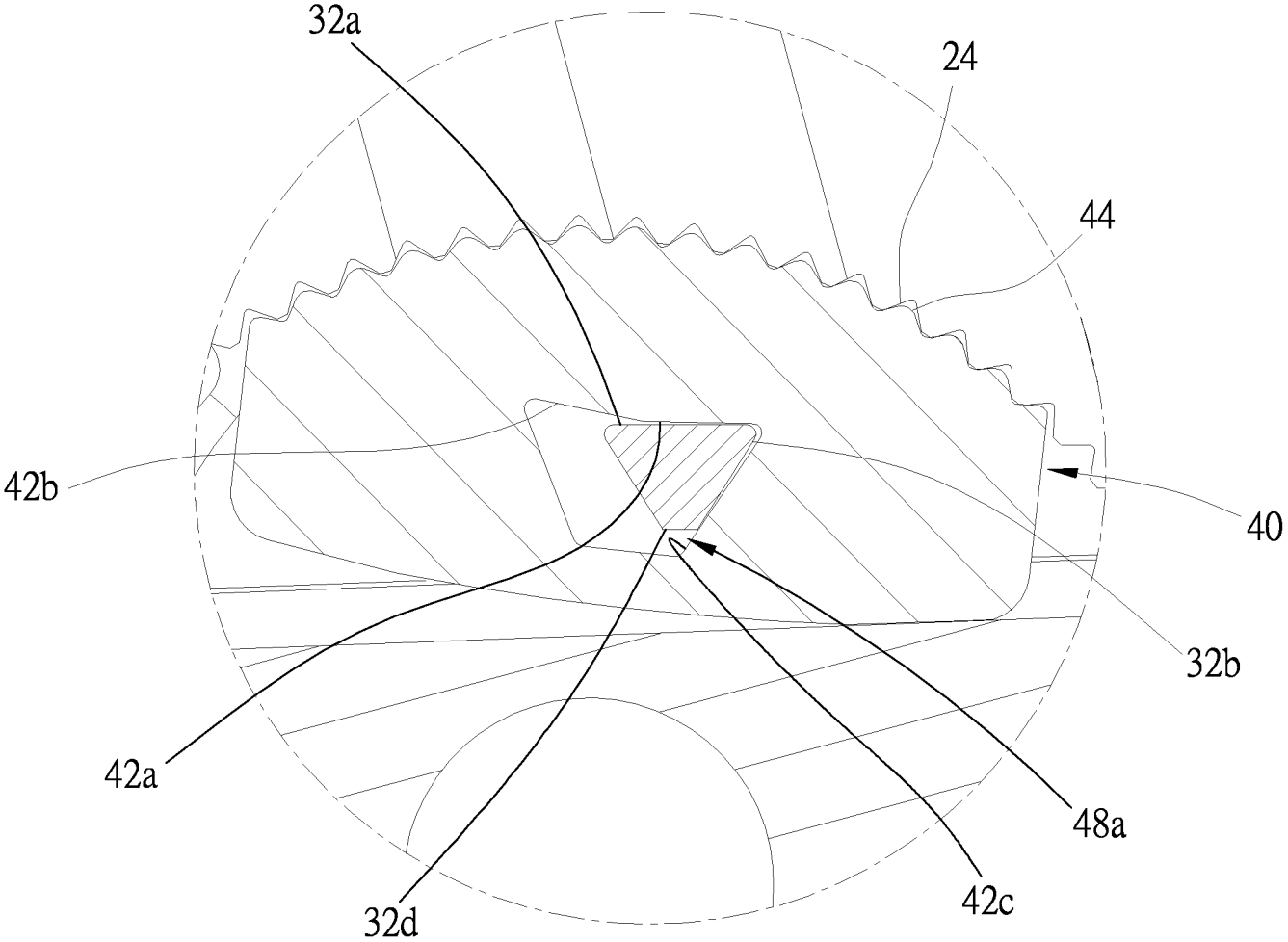
FIG. 10 is a partial enlarged view of the region A in FIG. 9.

FIG. 7 to FIG. 10 show that the switching member 30 is in the first position and the pawl member 40 is pivotally rotated to third position. In FIG. 7, when the switching member 30 is in the first position, the hollow pin 54 abuts against a bottom of the first accommodating groove 34*a*. As shown in FIGS. 9 and 10, when the pawl member 40 is in the third position, the ratchet teeth 44 mesh with the teeth 24, and the first abutting surface 32*a* is close to the first contact surface 42*a*, while the second abutting surface 32*b* is close to the third contact surface 42*c*. At this time, there will be a slight gap spaced apart between the first abutting surface 32*a* and the first contact surface 42*a*, and there will also be a slight gap spaced apart between the second abutting surface 32*b* and the third contact surface 42*c*. When the ratchet body 20 continuously rotates in a first rotation direction D1 due to an external force, the ratchet teeth 44 and the teeth 24 are mutually engaged and disengaged repeatedly. The second connecting portion 42 of the pawl member 40 will be restricted by the space limitation of the light gap, so that the pawl member 40 is unable to rotate excessively, which effectively prevents the pawl member 40 from irregular teeth disengagement. In addition, the first connecting portion 32 further has an interval surface 32*d* which is between and adjacently connected to the second abutting surface 32*b* and the third abutting surface 32*c*. Because the width of the third contact surface 42*c* is greater than the width of the second abutting surface 32*b*, a space 48*a* is spaced apart between the interval surface 32*d* and an area of the third contact surface 42*c* that is not close to the second abutting surface 32*b*. Thus, at the instant of teeth disengagement, the pawl member 40 enables to retract into the space 48*a*, and immediately, the pawl member 40 returns to the third position and meshes with the teeth 24. Therefore, the ratchet body 20 smoothly and continuously rotates in a first rotation direction D1 relative to the base 10. Furthermore, as shown in FIG. 9, to drive the ratchet body 20 to rotate in a second rotation direction D2 relative to the base 10, the first abutting portion 46*a* of the pawl member 40 abuts against the surface 14*a* of the convex column 14 of the base 10, so that the ratchet body 20 is unable to rotate along the second rotation direction D2 relative to the base 10. In other words, when a user controls the switching member 30 to move to the first position and drives the pawl member 40 move to the third position, the ratchet body 20 enables to rotate only in the first rotation direction D1 relative to the base 10, and cannot rotate in the second rotation direction D2.

Figure 11:
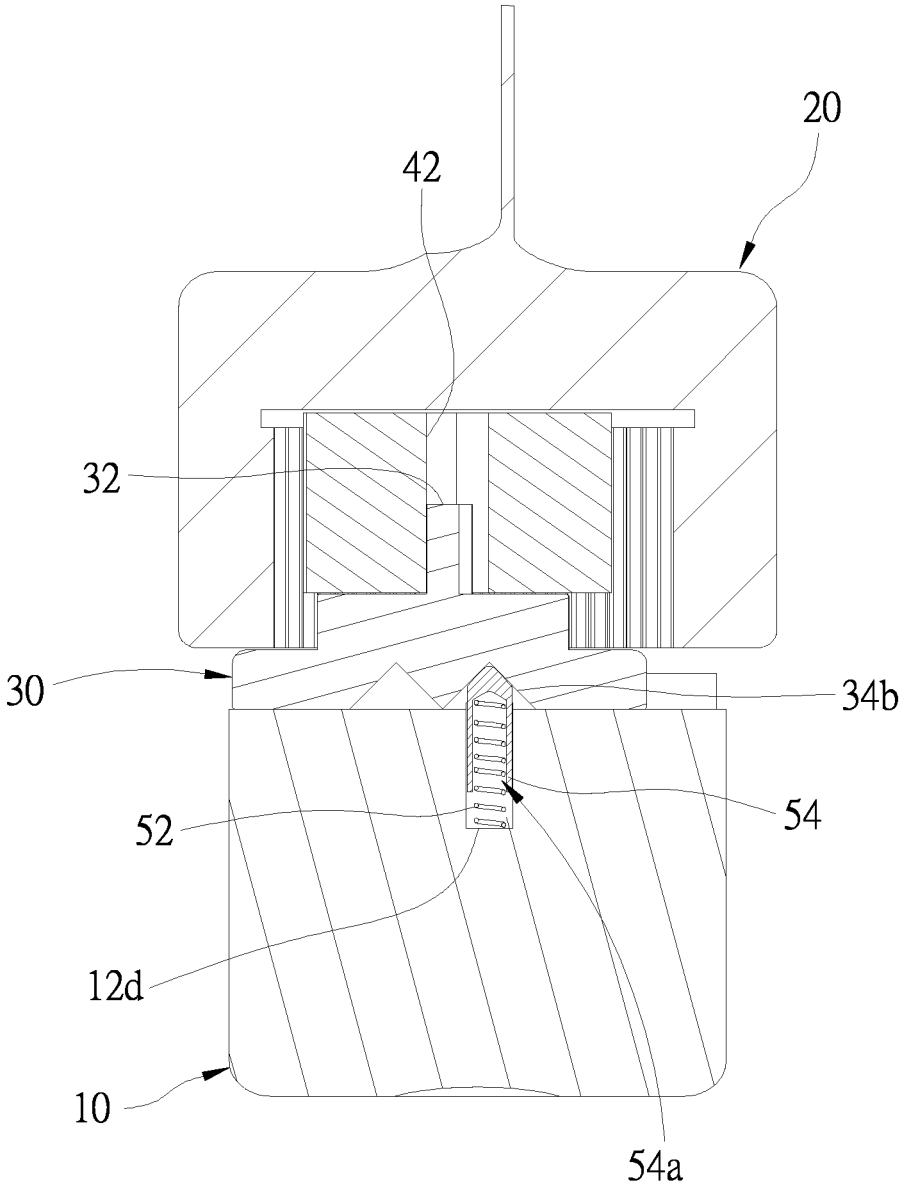
FIG. 11 is similar to FIG. 7, showing the switching member is in the second position and the pawl member is in the fourth position.
Figure 12:
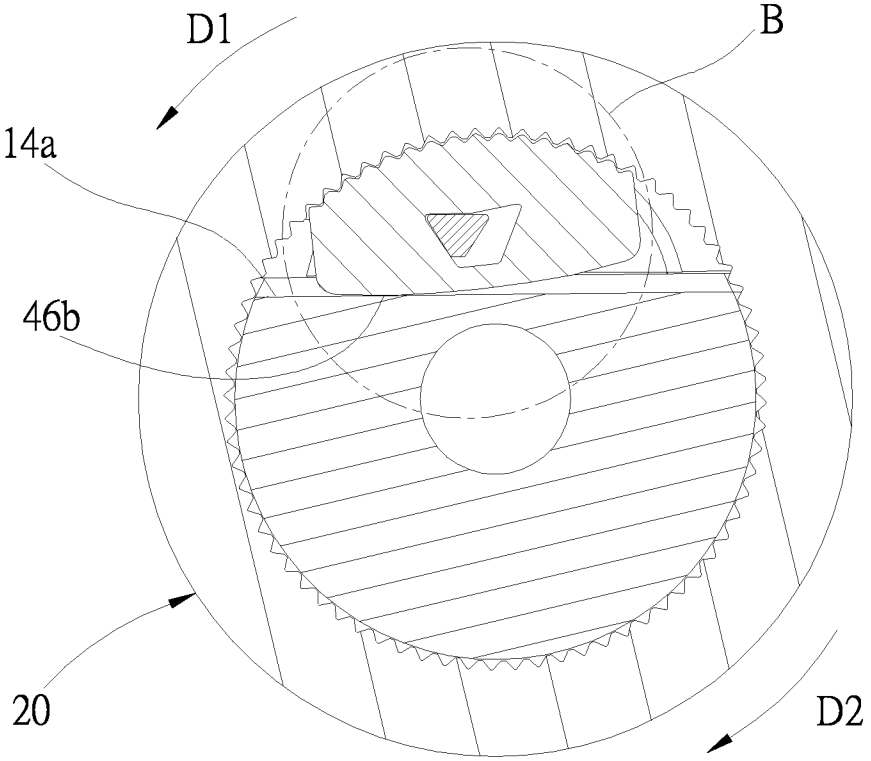
FIG. 12 is similar to FIG. 9, showing the switching member is in the second position and the pawl member is in the fourth position.
Figure 13:
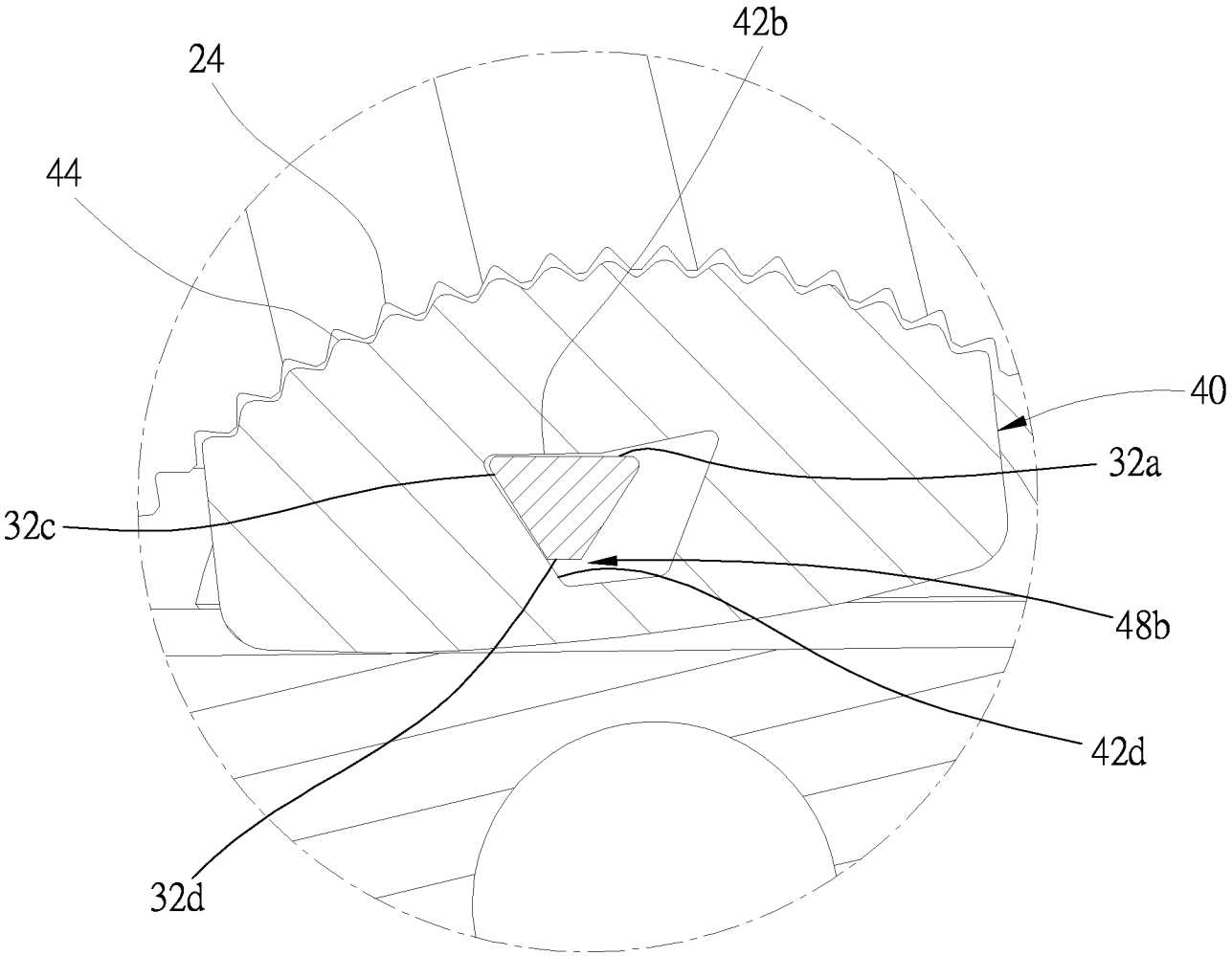
FIG. 13 is a partial enlarged view of the region B in FIG. 12.

FIG. 11 to FIG. 13 show that the switching member 30 is in the second position and the pawl member 40 is pivotally rotated to the fourth position. As show in FIG. 11, when the switching member 30 is in the second position, the hollow pin 54 abuts against a bottom of the second accommodating groove 34*b*. As show in FIG. 12 and FIG. 13, when the pawl member 40 is in the fourth position, the ratchet teeth 44 mesh with the teeth 24, and the first abutting surface 32*a* is close to the second contact surface 42*b*, while the third abutting surface 32*c* is close to the fourth contact surface 42*d*. In this time, there will be a slight gap spaced apart between the first abutting surface 32*a* and the second contact surface 42*b*, and there will also be a slight gap spaced apart between the third abutting surface 32*c* and the fourth contact surface 42*d*. When the ratchet body 20 continuously rotates in the second rotation direction due to an external force, the ratchet teeth 44 and the teeth 24 are mutually engaged and disengaged repeatedly. The second connecting portion 42 of the pawl member 40 will be restricted by the space limitation of the light gap, so that the pawl member 40 is unable to rotate excessively, which effectively prevents the pawl member 40 from irregular teeth disengagement. In addition, because the width of the fourth contact surface 42*d* is greater than the width of the third abutting surface 32*c*, a space 48*b* is spaced apart between the interval surface 32*d* and an area of the fourth contact surface 42*d* that is not close to the third abutting surface 32*c*. Thus, at the instant of teeth disengagement, the pawl member 40 enables to retract into the space 48*b*, and immediately, the pawl member 40 returns to the fourth position and meshes with the teeth 24. Therefore, the ratchet body 20 smoothly and continuously rotates in the second rotation direction D2 relative to the base 10. Furthermore, as shown in FIG. 12, to drive the ratchet body 20 to rotate in the first rotation direction D1 relative to the base 10, the second abutting portion 46*b* of the pawl member 40 abuts against the surface 14*a* of the convex column 14 of the base 10, so that the ratchet body 20 is unable to rotate along the first rotation direction D1 relative to the base 10. In other words, when a user controls the switching member 30 to move to the second position and drives the pawl member 40 move to the fourth position, the ratchet body 20 enables to rotate in the second rotation direction D2 only relative to the base 10, and cannot rotate in the first rotation direction D1.

The function for quickly changing the operation direction of the ratchet tool 1 in the present invention can be achieved via the switching member 30 that is linearly movable along the rail 12 between the first position and the second position for driving the pawl member 40 to pivotally rotate and mesh with the teeth 24 Additionally, once the user presses or pushes the switching member 30 by only using one hand, an idling direction of the ratchet tool 1 can be changed. As shown in FIG. 1, the user only needs to push the force application protrusion 38 of the switching member 30 with one hand to switch the operation direction of the ratchet tool 1 easily, allowing the user to intuitively operate and effectively improve the convenience of operation.

Figure 14:
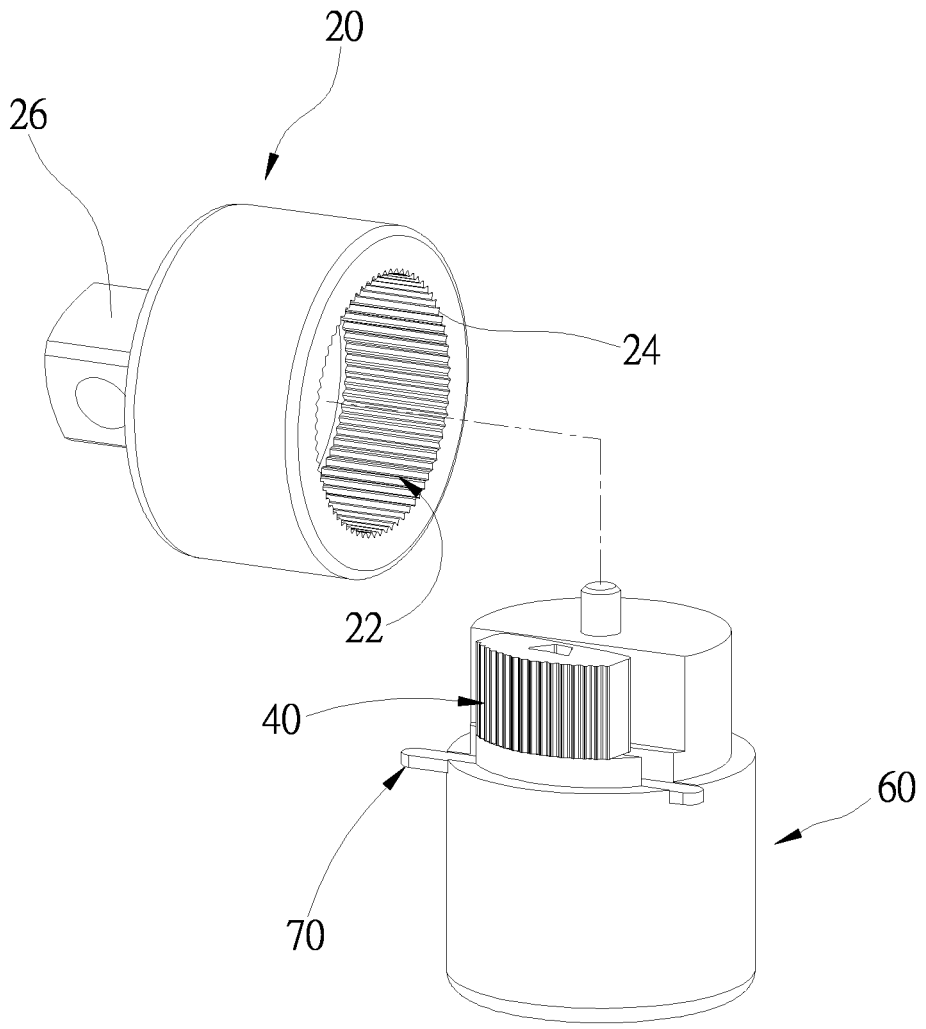
FIG. 14 and FIG. 15 are exploded views of the ratchet tool of the second embodiment of the present invention.
Figure 15:
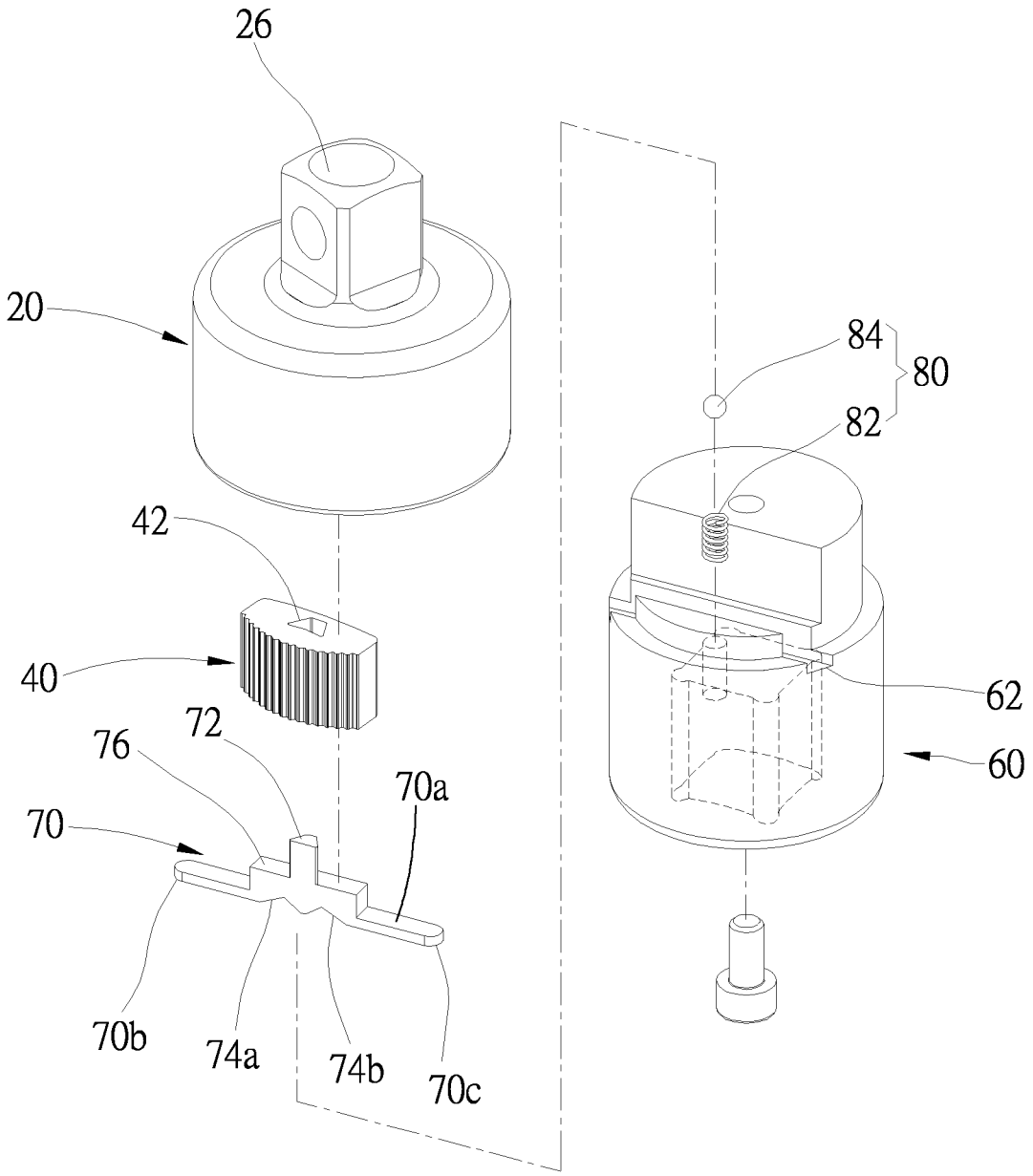
Figure 16:
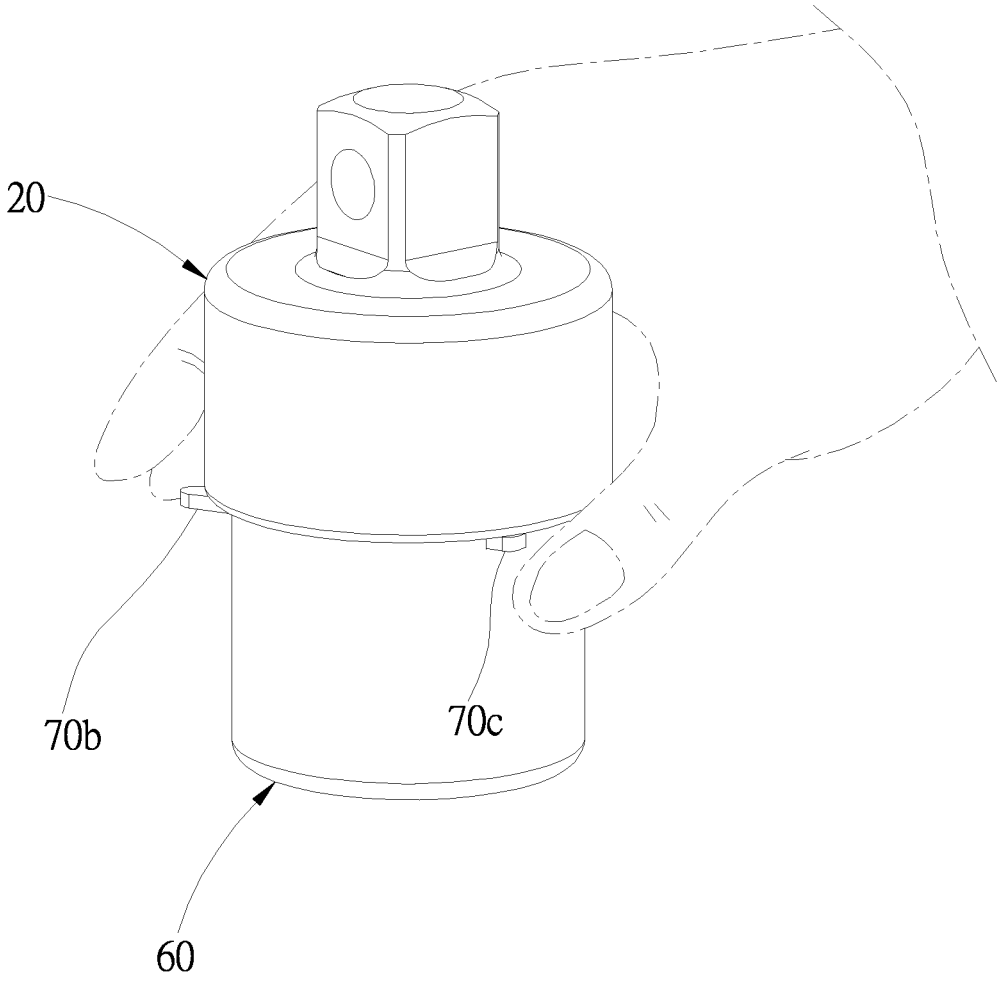
FIG. 16 is a perspective view of the ratchet tool of the second embodiment.

FIG. 14 to FIG. 16 show a second embodiment of the present invention, a ratchet tool, whose structure is roughly the same as the ratchet tool of the first embodiment. The rail 62 of the base 60 in the second embodiment is a cutting groove, two opposite groove walls of the cutting groove are parallel to each other, in addition, the rail 62 forms two openings at two sides of the base 60 respectively. A switching member 70 includes a holding platform 76 disposed under the first connecting portion 72, wherein the holding platform 76 is also provided for abutment against the pawl member 40. Particularly in the second embodiment, two sides of a first convex rib 70*a* of the switching member 70 extends to form two ends 70*b*, 70*c* separately, and the two ends 70*b*, 70*c* are located in the rail 62 and are movable linearly along the rail 62. Furthermore, at least one of the two ends 70*b*, 70*c* protrudes beyond the base 60 from one side of the rail 62. As shown in FIG. 16, in this embodiment, the two ends 70*b*, 70*c* protrudes beyond the base 60 respectively. Thus, the user can press one of the two ends 70*b*, 70*c* by a finger to drive the switching member 70 to move between the first position and the second position. In some embodiment, there is only one of the two ends protruding beyond the base. When the switching member 70 is in the first position, only the end 70*b* protrudes beyond the base 60, while the end 70*c* is retracted in the base 60; when the switching member 70 is in the second position, only the end 70*c* protrudes beyond the base 60, while the end 70*b* is retracted in the base 60. Therefore, the user may observe which of the two ends is the protruding one or the retracted one to identify the current idling direction of the ratchet tool. In addition, the difference of a positioning device 80 of this embodiment from the abovementioned embodiment is that the positioning device 80 includes an elastic member 82 and a positioning block 84, and the positioning block 84 can be but is not limited to a sphere. The advantage of adopting the spherical-shaped positioning block is that when the switching member 70 is controlled to switch between the first position and the second position, the positioning block 84 enables to slide more smoothly between the first accommodating groove 74*a* and the second accommodating groove 74*b*.

Figure 17:
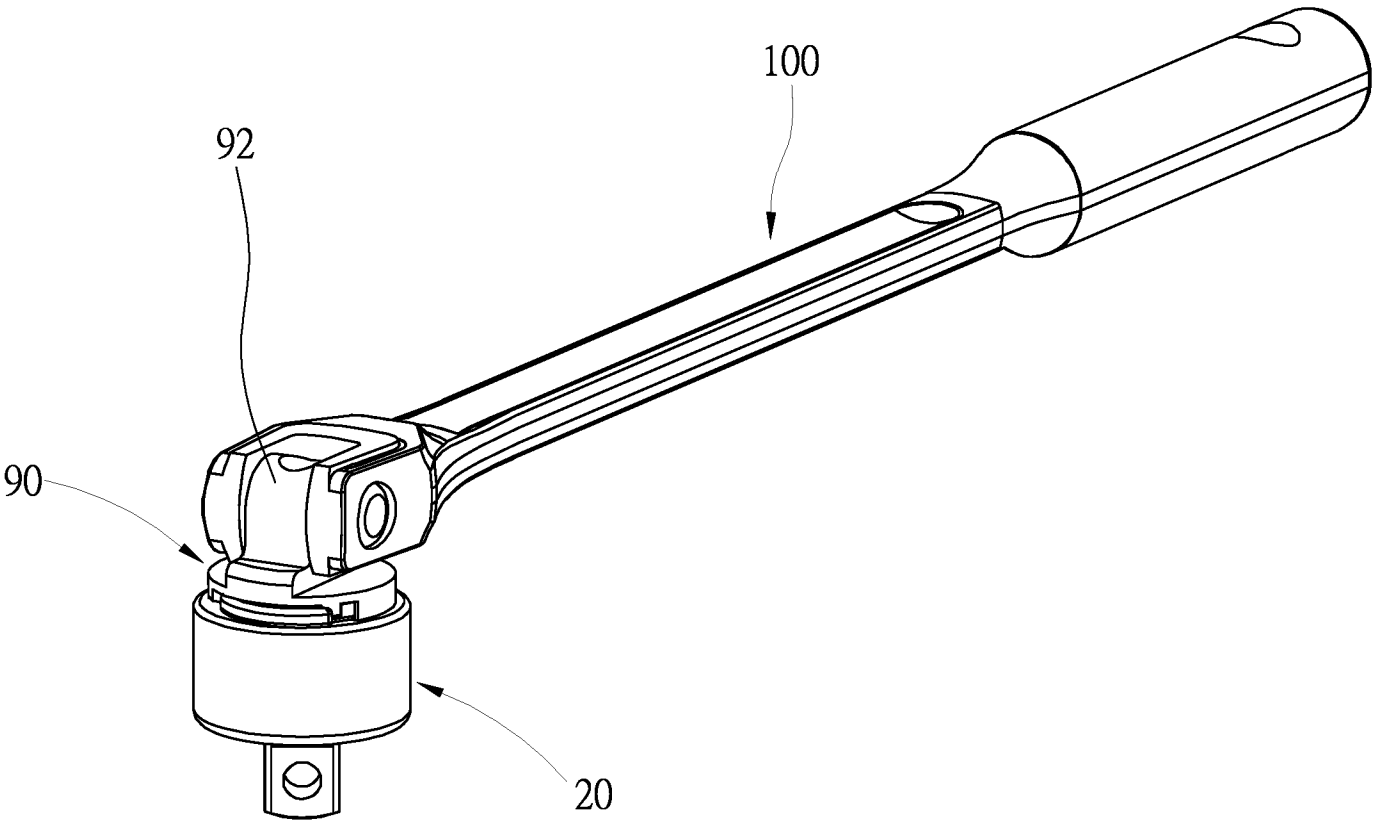
FIG. 17 is a perspective view of the ratchet tool of the third embodiment of the present invention.

FIG. 17 shows a perspective view of a ratchet tool of a third embodiment of the present invention. The structure of the ratchet tool of the present invention can not only be applied to the abovementioned ratchet adapters, but also be applied to a Flexible handle shown in the third embodiment. The difference of the third embodiment from the first embodiment is that, an annular periphery of the base 90 is retracted to form a pivot portion 92, and an end of a body 100 of the Flexible handle is pivotally connected to the pivot portion 92, so that the ratchet body 20 can swing relative to the body 100.

Figure 18:
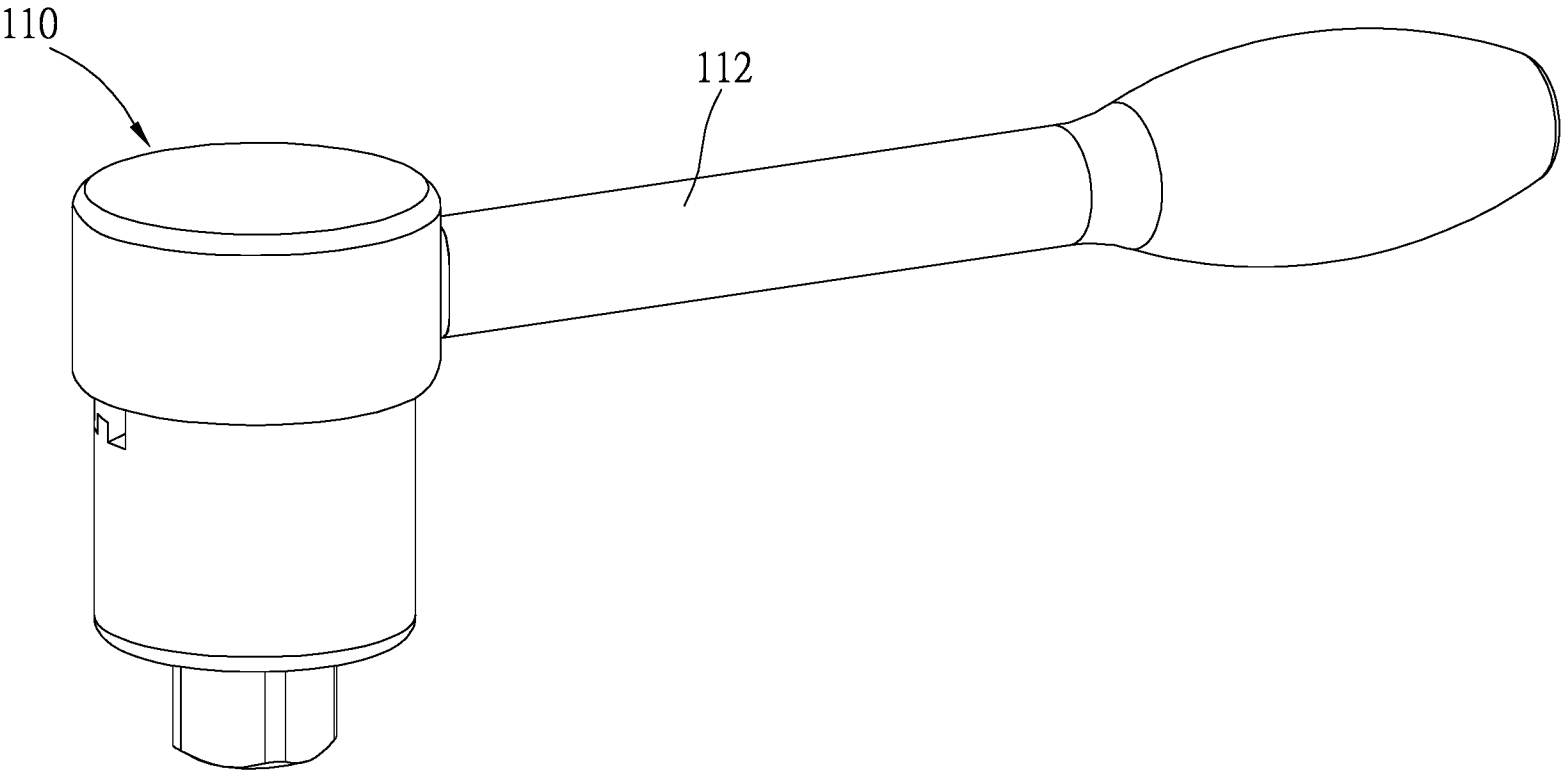
FIG. 18 a perspective view of the ratchet tool of the fourth embodiment of the present invention

FIG. 18 shows a perspective view of a ratchet tool of a fourth embodiment of the present invention. The ratchet tool of this embodiment is a socket wrench, wherein the main difference of the fourth embodiment from the first embodiment is that one side of a periphery of the ratchet body 110 extends to form a handle 112.

The embodiments described above are only preferred embodiments of the present invention. In other applications, the form of the rail is not only limited to the recessed cutting groove, but also be designed with a longitudinal bump; in addition, the corresponding cutting groove is designed at a bottom of the switching member to mate with the longitudinal bump, so that the switching member is linearly movable along the longitudinal bump between the first position and the second position. Various features have been particularly shown and described in connection with the disclosure as shown and described, however, it must be understood that these particular arrangements merely illustrate, and that the disclosure is to be given its fullest interpretation within the terms of the appended claims.

What is claimed is:

1. A ratchet tool, comprising:

a base having a rail;

a ratchet body having an inner circular surface which has a plurality of teeth formed thereon;

a switching member located in the rail, wherein the switching member is linearly movable between a first position and a second position along the rail; the switching member comprises a first connecting portion;

a pawl member having a plurality of ratchet teeth, a first abutting portion, a second abutting portion, and a second connecting portion, wherein the second connecting portion and the first connecting portion are connected to each other;

when the switching member moves to the first position, the switching member drives the pawl member to pivotally rotate to a third position, so that the ratchet teeth mesh with the teeth, and the first abutting portion abuts against the base so that the ratchet body is able to rotate only in a first rotation direction;

when the switching member moves to the second position, the switching member drives the pawl member to pivotally rotate to a fourth position, so that the ratchet teeth mesh with the teeth, and the second abutting portion abuts against the base so that the ratchet body is able to rotate only in a second rotation direction; the first rotation direction and the second rotation direction are opposite directions;

wherein the first connecting portion of the switching member has a first abutting surface, a second abutting surface, and a third abutting surface; the second connecting portion of the pawl member has a first contact surface, a second contact surface, a third contact surface, and a fourth contact surface; when the pawl member is pivotally rotated to the third position, the first abutting surface is close to the first contact surface, and the second abutting surface is close to the third contact surface; when the pawl member is pivotally rotated to the fourth position, the first abutting surface is close to the second contact surface, and the third abutting surface is close to the fourth contact surface;

wherein a width of the third contact surface is greater than a width of the second abutting surface, and a width of the fourth contact surface is greater than a width of the third abutting surface; when the pawl member is in the third position, there is a slight gap between the first abutting surface and the first contact surface, and there is a slight gap between the second abutting surface and the third contact surface; when the pawl member is in the fourth position, there is a slight gap between the first abutting surface and the second contact surface, and there is a slight gap between the third abutting surface and the fourth contact surface;

wherein an angle between the first contact surface and the second contact surface is greater than 180 degrees; an angle between the first contact surface and the third contact surface is an acute angle, and an angle between the second contact surface and the fourth contact surface is an acute angle; an angle sum of an angle between the first abutting surface and the second abutting surface as well as the angle between the first contact surface and the third contact surface is approximately less than 360 degrees; an angle sum of an angle between the first abutting surface and the third abutting surface as well as the angle between the second contact surface and the fourth contact surface is approximately less than 360 degrees.

2. The ratchet tool of claim 1, wherein the first connecting portion has an interval surface which is between and adjacently connected to the second abutting surface and the third abutting surface; when the pawl member is in the third position, a space is spaced apart between an area of the third contact surface that is not close to the second abutting surface and the interval surface; when the pawl member is in the fourth position, a space is spaced apart between the interval surface and an area of the fourth contact surface that is not close to the third abutting surface.

3. The ratchet tool of claim 1, wherein the switching member comprises a first convex rib and a holding platform provided on the first convex rib; the first connecting portion is formed on an upper surface of the holding platform; the pawl member is supported by the upper surface of the holding platform; the first convex rib is provided in the rail, and is movable along the rail linearly.

4. The ratchet tool of claim 3, wherein one side of the holding platform extends to form a force application protrusion; an extension direction of the force application protrusion is different from a moving direction of the switching member, and the force application protrusion protrudes beyond the base.

5. The ratchet tool of claim 4, wherein the rail comprises a cutting groove, a holding space, and a rib; the rib is provided between the cutting groove and the holding space for separating the cutting groove and the holding space; the first convex rib is movable in the cutting groove linearly; the force application protrusion is partially accommodated in the holding space.

6. The ratchet tool of claim 3, wherein the first convex rib of the switching member comprises two end portions, at least one of the end portions protrudes beyond the base from one side of the rail.

7. The ratchet tool of claim 1, wherein the switching member has a first accommodating groove and a second accommodating groove; a positioning device is provided on the rail; when the switching member moves to the first position, the positioning device abuts against the first accommodating groove; when the switching member moves to the second position, the positioning device abuts against the second accommodating groove.

8. The ratchet tool of claim 7, wherein the rail has a recess recessed into a bottom of the rail; the positioning device is provided in the recess and comprises an elastic member and a hollow pin; the hollow pin is located between the switching member and the elastic member; an end of the elastic member is inserted inside the hollow pin, and the hollow pin optionally abuts against the first accommodating groove or the second accommodating groove.

9. The ratchet tool of claim 1, wherein one of the first connecting portion and the second connecting portion is a polygonal column, while the other is a polygonal hole.

* * * * *